US010508818B2

(12) United States Patent
Xu et al.

(10) Patent No.: US 10,508,818 B2
(45) Date of Patent: Dec. 17, 2019

(54) WINDOW AIR CONDITIONER WITH SIDE INSULATING SEALING ASSEMBLY

(71) Applicants: GD MIDEA AIR-CONDITIONING EQUIPMENT CO., LTD., Foshan (CN); MIDEA GROUP CO., LTD., Foshan (CN)

(72) Inventors: Qiang Xu, Foshan (CN); Haiping Zhou, Foshan (CN); Jianjun Cao, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 192 days.

(21) Appl. No.: 15/400,248

(22) Filed: Jan. 6, 2017

(65) Prior Publication Data

US 2017/0191763 A1 Jul. 6, 2017

(30) Foreign Application Priority Data

| | | |
|---|---|---|
| Jan. 6, 2016 | (CN) | 2016 1 0013112 |
| Jan. 6, 2016 | (CN) | 2016 2 0018502 U |
| Jan. 14, 2016 | (CN) | 2016 1 0029681 |
| Jan. 14, 2016 | (CN) | 2016 2 0039391 U |

(51) Int. Cl.
*F24F 1/027* (2019.01)

(52) U.S. Cl.
CPC ..... *F24F 1/027* (2013.01)

(58) Field of Classification Search
CPC .... F24F 1/027; F24F 1/02; F24F 7/013; F24F 13/18; F24F 2221/20; E06B 3/48; E06B 3/4609; E06B 7/16
See application file for complete search history.

(56) References Cited

U.S. PATENT DOCUMENTS 3,587,441 A * 6/1971 Woods ..... E06B 9/0638 454/203
5,295,903 A 3/1994 Bolton et al.

FOREIGN PATENT DOCUMENTS

CN 203757876 U 8/2014
CN 205372819 U 7/2016

OTHER PUBLICATIONS

Chinese Patent Application No. 201610029681.3 Office Action dated Feb. 1, 2018, 12 pages.

* cited by examiner

*Primary Examiner* — Travis C Ruby
(74) *Attorney, Agent, or Firm* — Anova Law Group PLLC

(57) ABSTRACT

A window air conditioner is provided. The window air conditioner includes an air conditioner body configured to be mounted to a mounting window; and a heat-insulation sealing assembly having at least two layers and provided between the air conditioner body and the mounting window to insulate an inside of the mounting window from an outside of the mounting window.

13 Claims, 10 Drawing Sheets

WINDOW AIR CONDITIONER WITH SIDE INSULATING SEALING ASSEMBLY

RELATED APPLICATIONS

This application claims benefit of priority to each of the following patent applications: (a) Chinese Patent Application No. 201610013112.X filed with the State Intellectual Property Office on Jan. 6, 2016, (b) Chinese Patent Application No. 201620018502.1 filed with the State Intellectual Property Office on Jan. 6, 2016, (c) Chinese Patent Application No. 201610029681.3 filed with the State Intellectual Property Office on Jan. 14, 2016, and (d) Chinese Patent Application No. 201620039391.2 filed with the State Intellectual Property Office on Jan. 14, 2016. The entire content of each of the afore-mentioned applications is incorporated herein by reference.

FIELD

The present invention relates to a technical field of air conditioners, and particularly, to a window air conditioner.

BACKGROUND

The window air conditioner is usually installed in a window, and an accessory is needed in the installation of the window air conditioner. In related art, the installation accessory of the window air conditioner is an independent component separated from the window air conditioner, and includes an upper guiding track located on the top wall of a casing of the window air conditioner, a lower guiding track located below the bottom wall of the casing, a left curtain and a right curtain located at a left side and a right side of the casing respectively, and a left curtain frame and a right curtain frame to position the left curtain and the right curtain respectively. The upper guiding track and the lower guiding track are used to fix the whole window air conditioner and install the curtain frames, the curtain frame is a U-shaped frame disposed laterally, opening directions of the left curtain frame and the right curtain frame are opposed to each other, and the left curtain frame and the right curtain frame are inserted in the upper guiding track and the lower guiding track correspondingly and fixed to the window frame. The left curtain and the right curtain are disposed in the left curtain frame and the right curtain frame in a snap-fit manner correspondingly, one end of the curtain is connected with the casing of the window air conditioner in the snap-fit manner, and the other end thereof is fixed to the curtain frame after being drawn to its place.

When the window air conditioner is installed, since the accessories are disposed independently, respective accessories need to be installed respectively. For example, a louver has a tedious installation process and at least two installers are needed to finish the installation together. In addition, the independent accessory is difficult to preserve, easy to lose during disassembling, and needs to be packaged during transportation, thus increasing costs of transportation and packaging. In addition, since the curtain is usually made of foldable soft materials, seams tend to appear around the curtain after the curtain has been installed to its place and water tends to leak in through the seams when it rains, thus influencing a use safety of the window air conditioner.

In addition, when the louver is installed, a requirement of heat insulation R1 value needs to be satisfied. However, in the related art, the louver is configured as a thin PVC-extruded flexible curtain structure and cannot meet the R1 value requirement and the sealing requirement.

SUMMARY

The present invention aims to solve one of the technical problems above in the related art to at least some extent. Thus, one object of the present invention is to provide a window air conditioner, and the window air conditioner has a great heat-insulation sealing effect.

Embodiments of the present invention provide a window air conditioner, including an air conditioner body configured to be mounted to a mounting window; and a heat-insulation sealing assembly having at least two layers and provided between the air conditioner body and the mounting window to insulate an inside of the mounting window from an outside of the mounting window.

With the window air conditioner according to the embodiments of the present invention, by using the heat-insulation sealing assembly having at least two layers, the inside and the outside of the mounting window are insulated from each other effectively to reduce the heat-exchange efficiency between the inside and the outside of the mounting window, so as to reduce the energy consumption of the window air conditioner and save resources.

According to some embodiments of the present invention, the at least two layers of the heat-insulation sealing assembly are substantially parallel to each other.

According to some embodiments of the present invention, the at least two layers of the heat-insulation sealing assembly include a heat insulation plate.

According to some embodiments of the present invention, the heat insulation plate has a thickness of 3 to 30 mm.

Further, the heat insulation plate has a thickness of 5 to 20 mm.

According to some embodiments of the present invention, the heat insulation plate is an ethylene vinyl acetate heat insulation plate.

According to some embodiments of the present invention, the at least two layers of the heat-insulation sealing assembly include a sealing louver.

According to some embodiments of the present invention, the at least two layers of the heat-insulation sealing assembly include a sealing plate subassembly, and the sealing plate subassembly includes a fixed sealing plate group and a sliding sealing plate group connected with the fixed sealing plate group in a sealing manner, in which the fixed sealing plate group is disposed on a side wall of the air conditioner body, and the sliding sealing plate group is disposed at a side of the fixed sealing plate group away from the air conditioner body slidably in a direction approaching to or moving away from the air conditioner body.

According to some embodiments of the present invention, a sealing element is provided between the sliding sealing plate group and the fixed sealing plate group.

According to some embodiments of the present invention, the sealing element includes a sealing protruded strip extending along a length direction of the sliding sealing plate group and provided on at least one of the sliding sealing plate group and the fixed sealing plate group, and a free end of the sealing protruded strip touches the corresponding fixed sealing plate group or sliding sealing plate group.

According to some other embodiments of the present invention, the sealing element includes a sealing strip clamped between the sliding sealing plate group and the fixed sealing plate group, the sealing strip includes a U-shaped sealing groove, and the U-shaped sealing groove covers an end portion of the fixed sealing plate group toward the sliding sealing plate group or an end portion of the sliding sealing plate group toward the fixed sealing plate group.

Further, the sealing strip further includes a sealing edge strip extending along a length direction of the U-shaped sealing groove, and one end of the sealing edge strip is connected with the U-shaped sealing groove and the other end thereof touches the corresponding fixed sealing plate group or sliding sealing plate group.

According to some embodiments of the present invention, a thickness of at least one of the at least two layers of the heat-insulation sealing assembly is adjustable.

According to some embodiments of the present invention, at least one of the at least two layers of the heat-insulation sealing assembly is connected with the mounting window in the sealing manner via a sliding guiding portion slidable in a left and right direction with respect to the air conditioner body.

According to some embodiments of the present invention, the window air conditioner further includes a fixed guiding portion disposed to the air conditioner body, in which the sliding guiding portion is slidably fitted with the fixed guiding portion.

According to some embodiments of the present invention, the fixed guiding portion includes a first fixed member connected with the air conditioner body and the heat-insulation sealing assembly in a snap-fit manner respectively.

According to some embodiments of the present invention, a snap connected with the air conditioner body in the snap-fit manner is provided at a side of the first fixed member, and a snap groove matched with the first snap is provided in the side wall of the air conditioner body.

According to some embodiments of the present invention, a plurality of the snap grooves are provided and spaced apart from one another along a length direction of the first fixed member.

According to some embodiments of the present invention, the first snap includes an extending portion extending outwards from a side of the first fixed member facing the air conditioner body, and the extending portion has two snapping members at a free end thereof and the two snapping members extend away from each other; two side wings are provided on the side wall of the air conditioner body and spaced apart from each other, and configured to form the snap groove, and each side wing is configured to have a substantial L shape.

According to some embodiments of the present invention, the fixed guiding portion includes a second fixed member disposed on a top wall and/or a bottom wall of the air conditioner body, and the sliding guiding portion is slidably disposed on the second fixed member.

According to some embodiments of the present invention, one of the second fixed member and the sliding guiding portion has a guiding groove extending along a sliding direction of the sliding guiding portion, and the other thereof has a guiding slide track matched with the guiding groove.

According to some embodiments of the present invention, the sliding guiding portion includes a first support plate slidably fitted with the fixed guiding portion, and the first support plate has a guiding sliding groove and at least a part of the heat-insulation sealing assembly is fitted in the guiding sliding groove.

Further, the sliding guiding portion further includes: a second support plate paralleled to the first support plate and spaced apart from the first support plate in a length direction of the heat-insulation sealing assembly; and a connecting plate connected between the first support plate and the second support plate, in which the heat-insulation sealing assembly is connected with the connecting plate in a snap-fit manner.

According to some embodiments of the present invention, one of the connecting plate and an end of the heat-insulation sealing assembly opposite to the connecting plate is provided with a second snap, and the other thereof is provided with a snapping member connected with the second snap in the snap-fit manner.

According to some embodiments of the present invention, two second snaps are provided and spaced apart from each other along the length direction of the heat-insulation sealing assembly.

According to some embodiments of the present invention, the first support plate includes: a main plate; two side plates disposed at one side of the main plate and configured to define the guiding sliding groove; and a guiding plate disposed at the other side of the main plate and slidably fitted with the fixed guiding portion.

According to some embodiments of the present invention, the guiding plate is flush with one of the two side plates.

According to some embodiments of the present invention, the sliding guiding portion is provided with a first mounting groove extending along the length direction of the heat-insulation sealing assembly, and one end of one of the at least two layers of the heat-insulation sealing assembly is configured to be inserted into the first mounting groove along a length direction of the first mounting groove.

According to some embodiments of the present invention, the fixed guiding portion is provided with a second mounting groove opposite to the first mounting groove, and the other end of the one of the at least two layers of the heat-insulation sealing assembly is mounted in the second mounting groove.

According to some embodiments of the present invention, the heat-insulation sealing assembly includes a layer of a sealing louver and a layer of a heat insulation plate, the sealing louver is flexibly provided between the mounting window and the air conditioner body and adjacent to the outside of the mounting window, while the heat insulation plate is provided adjacent to the inside of the mounting window.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of embodiments of the present disclosure will become apparent and more readily appreciated from the following descriptions made with reference the accompanying drawings, in which.

Figure 1:
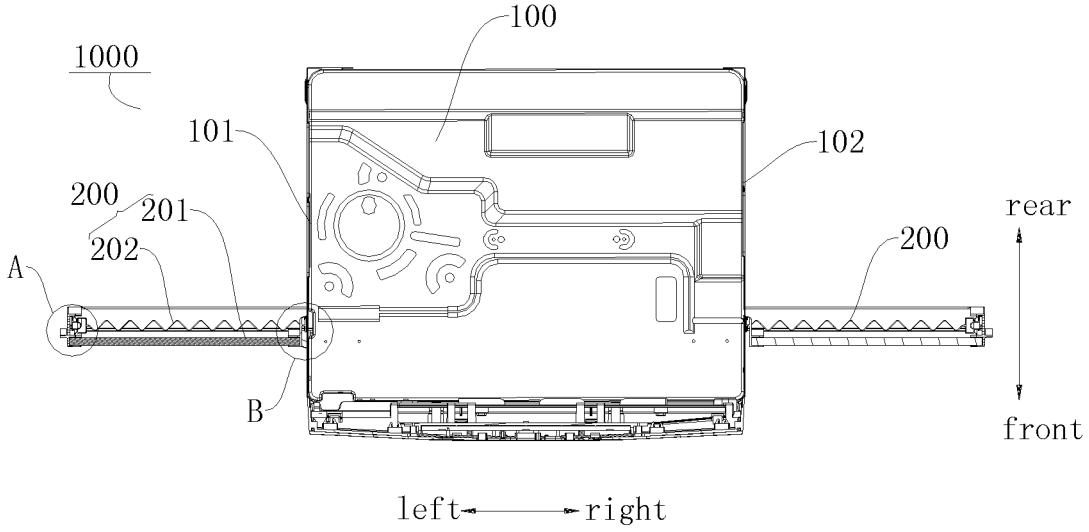
FIG. 1 is a sectional view of a window air conditioner according to an embodiment of the present invention.

REFERENCE NUMERALS window air conditioner 1000, air conditioner body 100, left side wall 101, right side wall 102, top wall 103, side wing 110, snap groove 120, heat-insulation sealing assembly 200, heat insulation plate 201, first mounting groove 2011, sealing louver 202, second snap 2021, snapping groove 2022, concave portion 2023, sealing plate subassembly 203, fixed sealing plate group 210, fixed sealing plate subgroup 211, sliding sealing plate group 220, sealing protruded strip 231, sealing element 230, U-shaped sealing groove 232, sealing edge strip 233, sliding guiding portion 310, guiding slide track 311, first support plate 312, guiding sliding groove 3121, main plate 3122, side plate 3123, guiding plate 3124, second support plate 313, connecting plate 314, snapping member 3141, fixed guiding portion 320, first fixed member 321, first snap 3211, first extending portion 3212, first snapping member 3213, second mounting groove 3214, second fixed member 322, guiding groove 3221.

DETAILED DESCRIPTION

Embodiments of the present invention will be described in detail and examples of the embodiments will be illustrated in the accompanying drawings, where same or similar reference numerals are used to indicate same or similar members or members with same or similar functions. The embodiments described herein with reference to the drawings are explanatory, which aim to illustrate the present invention, but shall not be construed to limit the present invention.

In the specification, it shall be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation or position as then described or as shown in the drawings under discussion. These relative terms are for convenience of description and do not indicate or imply that the present invention must have a particular orientation, or be constructed or operated in a particular orientation, and thus shall not be construed to limit the present invention. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means at least two such as two or three, unless specified otherwise.

In the present invention, unless specified or limited otherwise, the terms "mounted," "connected," "coupled" and the like are used broadly, and may be, for example, fixed connections, detachable connections, or integral connections; may also be mechanical, electrical connections or can communicate with each; may also be direct connections or indirect connections via intervening structures; may also be inner communications or interaction of two elements, which can be understood by those skilled in the art according to specific situations.

In the following, a window air conditioner 1000 according to embodiments of the present invention will be described in detail with reference to FIG. 1 to FIG. 21.

As shown in FIG. 1 to FIG. 21, the window air conditioner 1000 according to embodiments of the present invention includes an air conditioner body 100 and a heat-insulation sealing assembly 200.

Specifically, the window air conditioner 1000 is configured to be mounted to a mounting window, and the air conditioner body 100 may be connected with the mounting window in a sealing manner via the heat-insulation sealing assembly 200. It shall be noted that the window air conditioner 1000 may be mounted in the mounting window. It should be understood that "mounting window" may refer to any kind of carrier, to which the window air conditioner 1000 can be mounted.

As shown in FIG. 1 to FIG. 4, the heat-insulation sealing assembly 200 includes at least two layers and is provided between the air conditioner body 100 and the mounting window to insulate an inside of the mounting window from an outside of the mounting window. For example, as shown in FIG. 1, the inside of the mounting window may refer to a front side shown in FIG. 1, while the outside of the mounting window may refer to a rear side shown in FIG. 1.

It may be understood that when the window air conditioner 1000 is refrigerating or heating, the window air conditioner 1000 may give out refrigeration energy or heat to the inside of the mounting window. The heat-insulation sealing assembly 200 may be used to insulate the inside of the mounting window from the outside of the mounting window to prevent the refrigeration energy or heat generated by the window air conditioner 1000 from being transmitted to the outside of the mounting window too fast, so as to reduce the energy consumption of the window air conditioner 1000 effectively and save resources.

With the window air conditioner 1000 according to the embodiments of the present invention, by using the heat-insulation sealing assembly 200 having at least two layers, the inside and outside of the mounting window are insulated from each other effectively to reduce the heat-exchange efficiency between the inside and outside of the mounting window, so as to reduce the power consumption of the window air conditioner 1000 and save resources.

Figure 4:
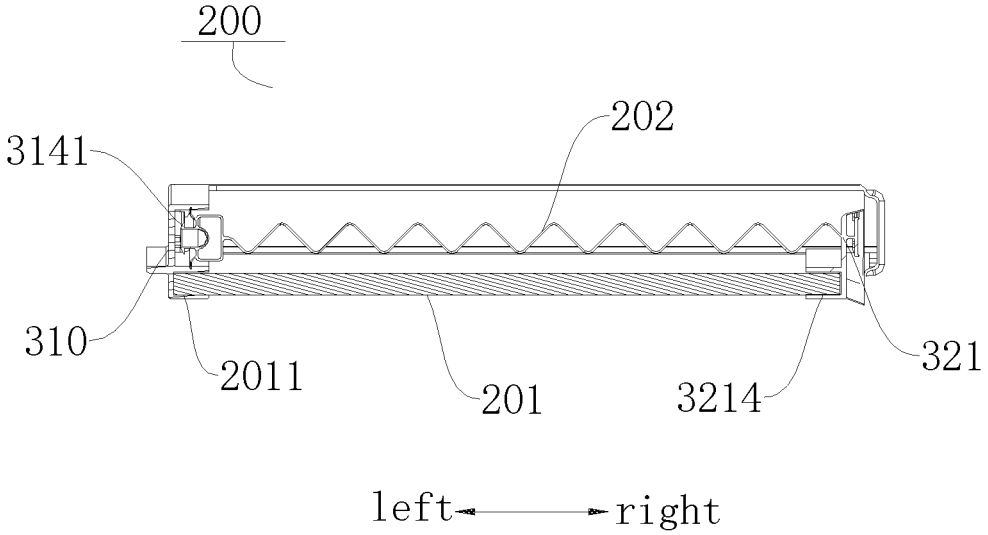
FIG. 4 is a sectional view of a heat-insulation sealing assembly of a window air conditioner according to an embodiment of the present invention.
Figure 5:
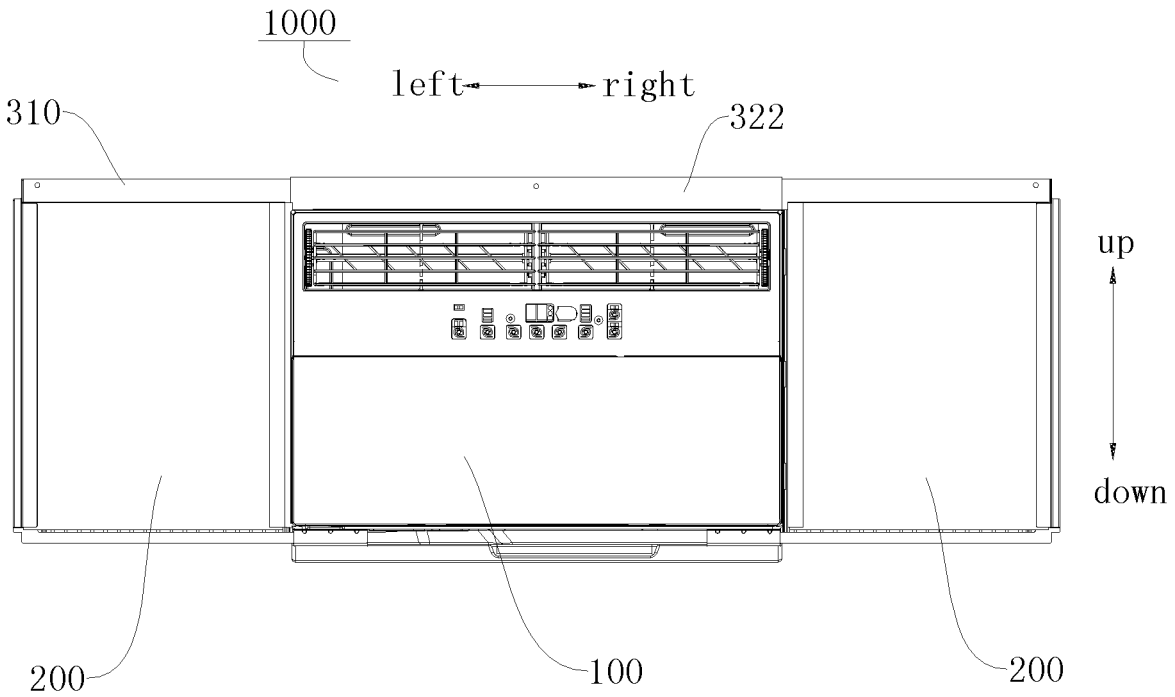
FIG. 5 is a front view of a window air conditioner according to an embodiment of the present invention.
Figure 6:
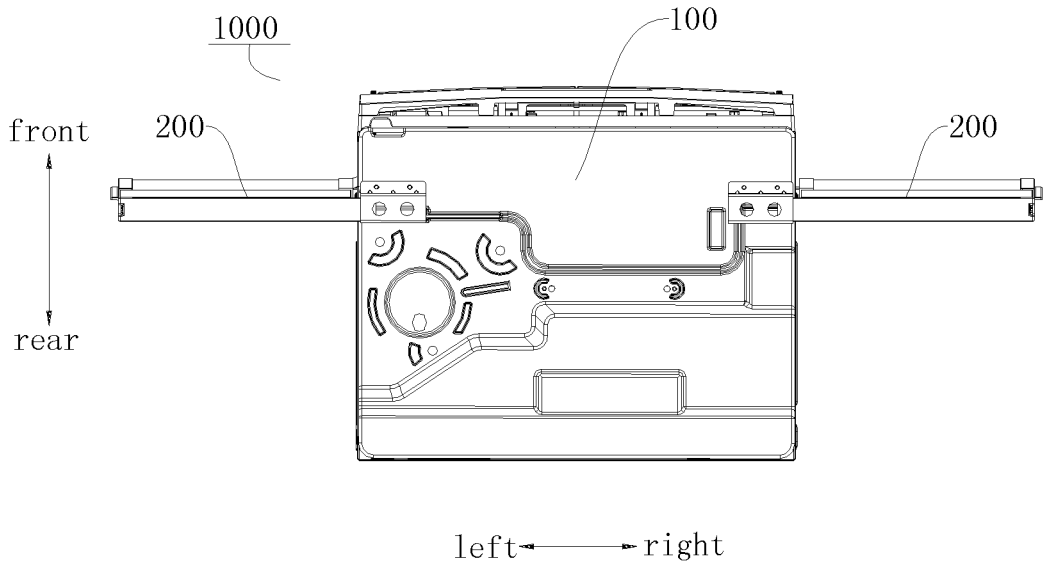
FIG. 6 is a bottom view of a window air conditioner according to an embodiment of the present invention.

According to an embodiment of the present invention, as shown in FIG. 1 and FIG. 4, the at least two layers of the heat-insulation sealing assembly 200 are substantially parallel to each other, such that the structural compactness of the window air conditioner 1000 and the heat-insulation sealing effect of the heat-insulation sealing assembly 200 can be improved. According to an embodiment of the present invention, the thickness of at least one of the at least two layers of the heat-insulation sealing assembly is adjustable, to facilitate adjusting the thickness of the heat-insulation sealing assembly 200 based on the size of the window. Thus, the heat-insulation sealing assembly 200 may be suitable for different installation conditions, so as to enlarge an application scope of the heat-insulation sealing assembly 200 and reduce a stock amount thereof, thereby saving the production cost.

As shown in FIG. 2 to FIG. 3 and FIG. 9 to FIG. 12, according to an embodiment of the present invention, the at least two layers of the heat-insulation sealing assembly 200 include a heat insulation plate 201. In the related art, the Energy Star product has the requirement for the installation accessory (e.g. the heat-insulation sealing assembly in embodiments of the present invention) of the window air conditioner that the heat-insulation R1 value should be satisfied. In the embodiment of the present invention, the heat-insulation sealing assembly 200 of the window air conditioner 1000 can meet the R1 value requirement by using the heat insulation plate 201.

In an example of the present invention, the heat insulation plate 201 may be an ethylene vinyl acetate (EVA) heat insulation plate. Thus, the heat-insulation sealing assembly 200 can satisfy the heat insulation R1 value for heat insulation, and has the great sealing property and appearance. It shall be noted that the EVA heat insulation plate may be made of EVA foam materials. The EVA heat insulation plate 201 has a certain degree of elasticity, a certain degree of flexibility compared with plastics, and a certain degree of hardness compared with sponges, such that the EVA heat insulation plate is not easy to be deformed when installed or used and has a good heat insulation effect. Additionally, the EVA heat insulation plate 201 may be cut or the installation width thereof may be adjusted based on the size of the window, so as to satisfy the installation requirements of different windows.

Further, the heat insulation plate 201 may have a thickness of 3 to 30 mm to improve the sealing heat insulation effect of the heat-insulation sealing assembly 200. Furthermore, the heat insulation plate 201 may have a thickness of 5 to 20 mm to further improve the sealing heat insulation effect of the heat-insulation sealing assembly 200.

Figure 2:
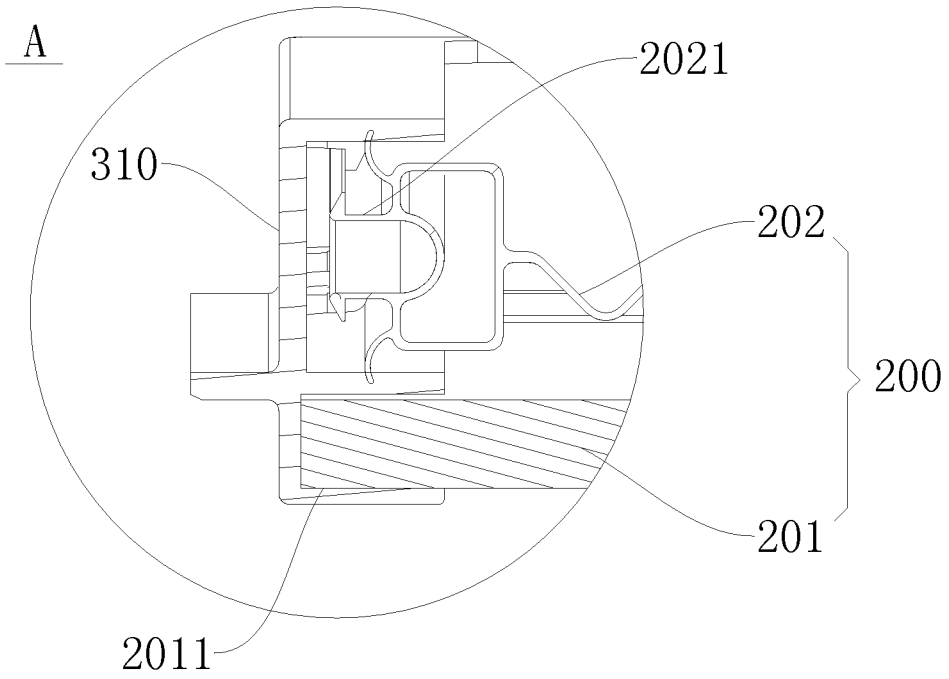
FIG. 2 is a partially enlarged view of portion A in FIG. 1.
Figure 3:
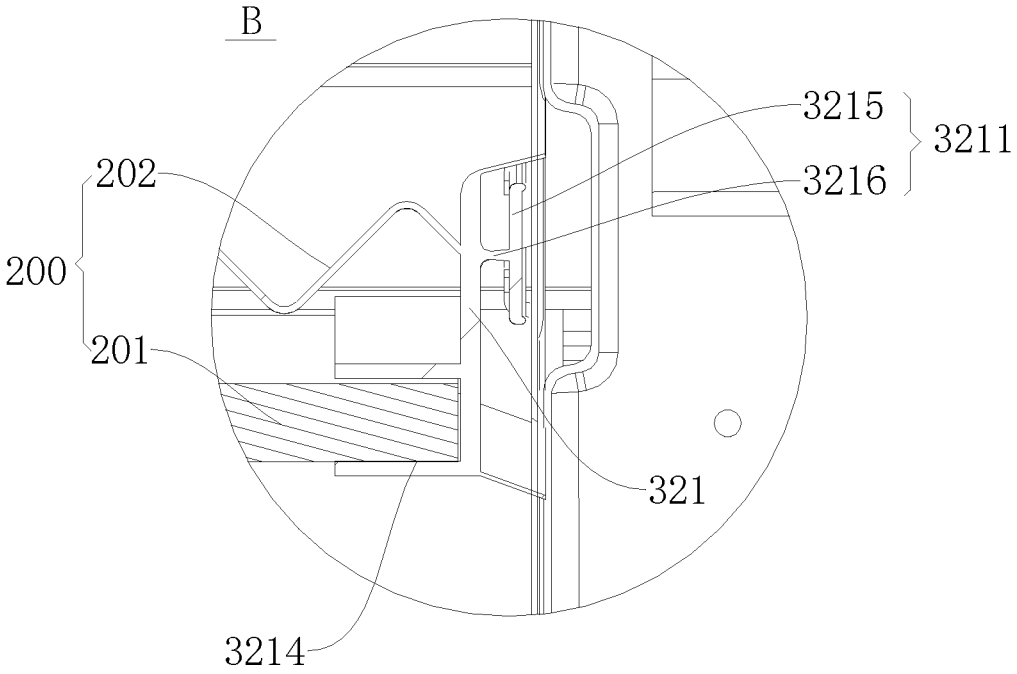
FIG. 3 is a partially enlarged view of portion B in FIG. 1.
Figure 12:
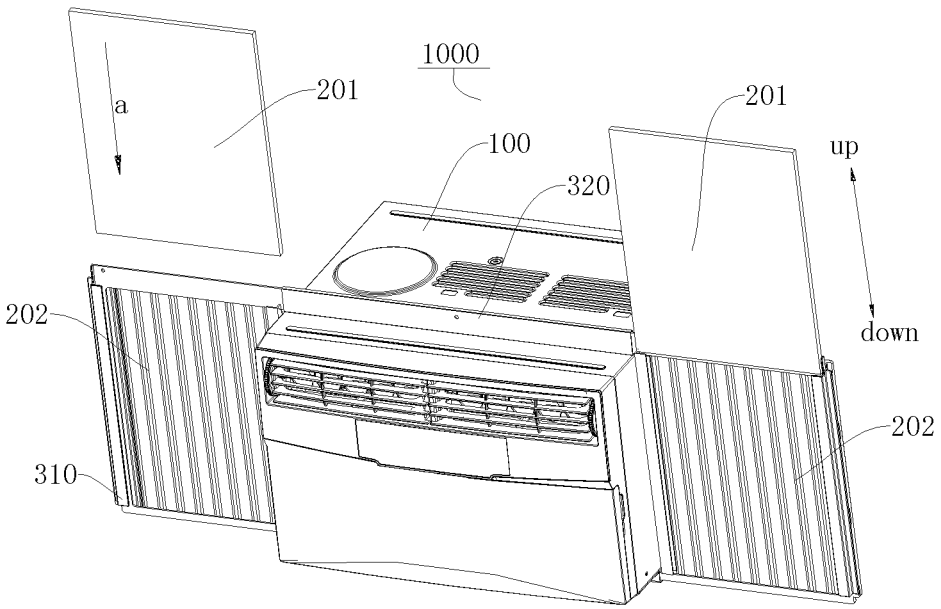
FIG. 12 is an exploded perspective view of a window air conditioner according to an embodiment of the present invention.

As shown in FIG. 2, FIG. 3 and FIG. 12, according to an embodiment of the present invention, the at least two layers of the heat-insulation sealing assembly 200 may further include a sealing louver 202. It shall be noted that a width of the sealing louver 202 is adjustable. For example, as shown in FIG. 1, the width of the sealing louver 202 in a left and right direction is adjustable to facilitate adjusting the width of the sealing louver 202 based on the size of the window, so as to make the heat-insulation sealing assembly 200 suitable for different installation conditions.

Figure 17:
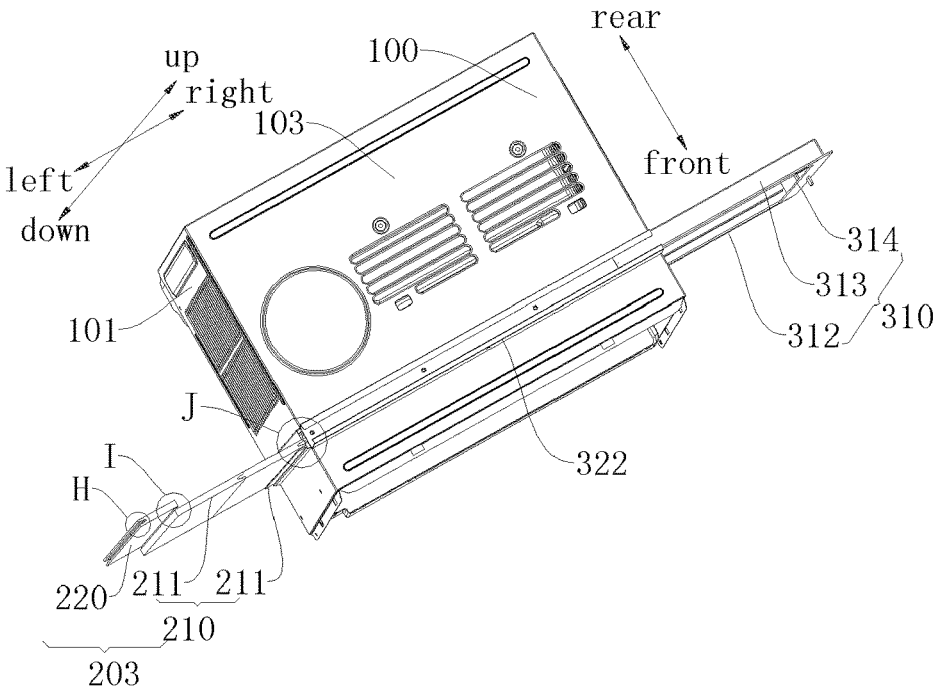
FIG. 17 is a partial schematic view of a window air conditioner according to another embodiment of the present invention shown in FIG. 15.
Figure 18:
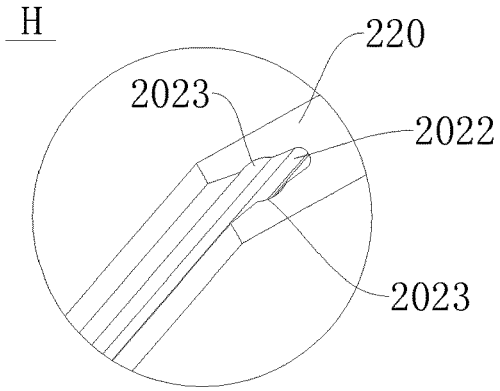
FIG. 18 is a partially enlarged view of portion H in FIG. 17.

According to another embodiment of the present invention, as shown in FIG. 17, the at least two layers of the heat-insulation sealing assembly 200 may further include a sealing plate subassembly 203. The sealing plate subassembly 203 includes a fixed sealing plate group 210 and a sliding sealing plate group 220 connected with the fixed sealing plate group 210 in a sealing manner, in which the fixed sealing plate group 210 is disposed on a side wall of the air conditioner body 100, and the sliding sealing plate group 220 is disposed at a side of the fixed sealing plate group 210 away from the air conditioner body 100 slidably in a direction approaching to or moving away from the air conditioner body 100.

It should be noted that, by using the slidable sliding sealing plate group 220 to adjust a distance between the air conditioner body and the window frame, not only the window air conditioner 1000 is convenient to be installed to the window frame, the application scope of the sealing plate subassembly 203 is also enlarged, so that the sealing plate subassembly 203 is suitable for different installation conditions, thus reducing a stock amount of the sealing plate subassembly 203 and saving the production cost. In addition, by connecting the fixed sealing plate group 210 and the sliding sealing plate group 220 in the sealing manner, the inside environment and the outside environment of the mounting window are insulated effectively, and the heat exchange efficiency between the inside environment and the outside environment is reduced, thus reducing the power consumption of the window air conditioner 1000 and saving resources.

For example, in the example shown in FIG. 17, two sealing plate subassemblies 203 are provided and disposed at a left side wall 101 and a right side wall 102 of the air conditioner body 100 respectively. In particular, in the sealing plate subassembly 203 located at the left side wall 101 of the air conditioner body 100, the fixed sealing plate group 210 is connected with the left side wall 101 of the air conditioner body 100 in the sealing manner, and the sliding sealing plate group 220 is slidable with respect to the fixed sealing plate group 210 along a left and right direction (e.g. a left and right direction shown in FIG. 17) and connected with the fixed sealing plate group 210 in the sealing manner; in the sealing plate subassembly 203 located at the right side wall 102 of the air conditioner body 100, the fixed sealing plate group 210 is connected with the right side wall 102 of the air conditioner body 100 in the sealing manner, and the sliding sealing plate group 220 is slidable with respect to the fixed sealing plate group 210 along the left and right direction (e.g., the left and right direction shown in FIG. 17) and connected with the fixed sealing plate group 210 in the sealing manner.

According to the embodiment of the present invention, as shown in FIG. 17, the fixed sealing plate group 210 may include a plurality of fixed sealing plate sub-groups 211 connected with one another in the sealing manner, to facilitate adjusting the width of the sealing plate subassembly 203, so as to make the sealing plate subassembly 203 suitable for different installation conditions.

Figure 19:
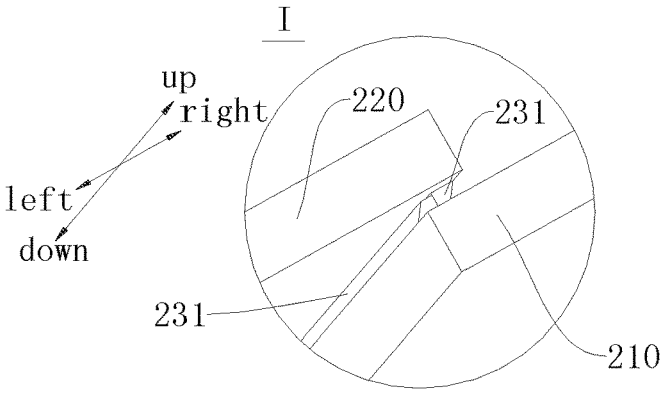
FIG. 19 is a partially enlarged view of portion I in FIG. 17.

In the embodiment, as shown in FIG. 17 and FIG. 19, a sealing element 230 is provided between the sliding sealing plate group 220 and the fixed sealing plate group 210 to improve the structural sealing performance of the sealing plate subassembly 203.

As shown in FIG. 17 and FIG. 19, the sealing element 230 may include a sealing protruded strip 231 extending along a length direction of the sliding sealing plate group 220 and disposed on at least one of the sliding sealing plate group 220 and the fixed sealing plate group 210, and a free end of the sealing protruded strip 231 touches the corresponding fixed sealing plate group 210 or sliding sealing plate group 220. For example, as shown in FIG. 19, each of the sliding sealing plate group 220 and the fixed sealing plate group 210 is provided with the sealing protruded strip 231, the free end of the sealing protruded strip 231 located on the sliding sealing plate group 220 touches the fixed sealing plate group 210, and the free end of the sealing protruded strip 231 located on the fixed sealing plate group 210 touches the sliding sealing plate group 220. Therefore, the connection sealing performance between the sliding sealing plate group 220 and the fixed sealing plate group 210 can be improved.

Further, as shown in FIG. 19, the sealing protruded strip 231 located on the sliding sealing plate group 220 may be disposed at an end portion of the sliding sealing plate group 220 close to the air conditioner body 100, and the sealing protruded strip 231 located on the fixed sealing plate group 210 may be disposed at an end portion of the fixed sealing plate group 210 away from the air conditioner body 100.

Figure 21:
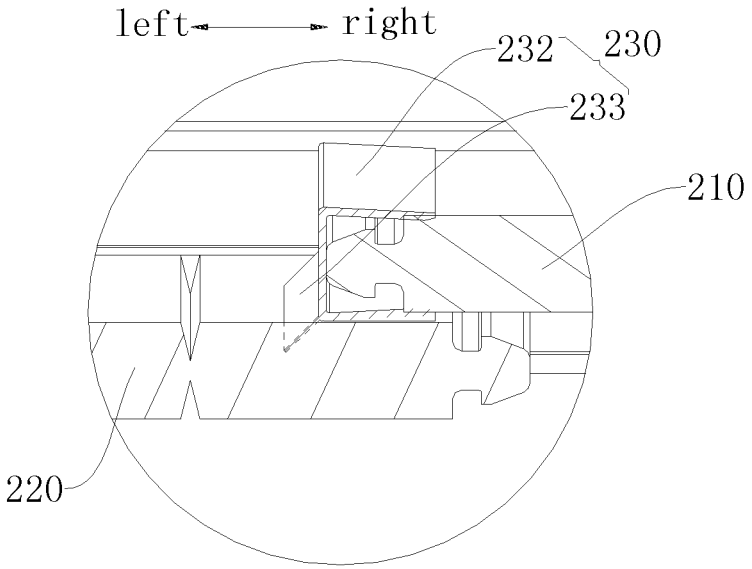
FIG. 21 is a partial schematic view of a window air conditioner according to an embodiment of the present invention.

Optionally, as shown in FIG. 21, the sealing element 230 may include a sealing strip clamped between the sliding sealing plate group 220 and the fixed sealing plate group 210. The sealing strip may include a U-shaped sealing groove 232, and the U-shaped sealing groove 232 covers an end portion of the fixed sealing plate group 210 toward the sliding sealing plate group 220 or an end portion of the sliding sealing plate group 220 toward the fixed sealing plate group 210. For example, one U-shaped sealing groove 232 may be provided and cover the end portion of the fixed sealing plate group 210 facing the sliding sealing plate group 220 or the end portion of the sliding sealing plate group 220 facing the fixed sealing plate group 210. Certainly, two U-shaped sealing grooves 232 may also be provided and cover the end portion of the fixed sealing plate group 210 facing the sliding sealing plate group 220 and the end portion of the sliding sealing plate group 220 facing the fixed sealing plate group 210 respectively.

Further, as shown in FIG. 21, the sealing strip further includes a sealing edge strip 233 extending along a length direction of the U-shaped sealing groove 232, and one end of the sealing edge strip 233 is connected with the U-shaped sealing groove 232 and the other end thereof touches the fixed sealing plate group 210 or the sliding sealing plate group 220. For example, as shown in FIG. 21, the U-shaped sealing groove 232 of the sealing strip covers the end portion of the fixed sealing plate group 210 close to the sliding sealing plate group 220, one end of the sealing edge strip 233 is connected with the U-shaped sealing groove 232 and the other end thereof touches the sliding sealing plate group 220.

Figure 13:
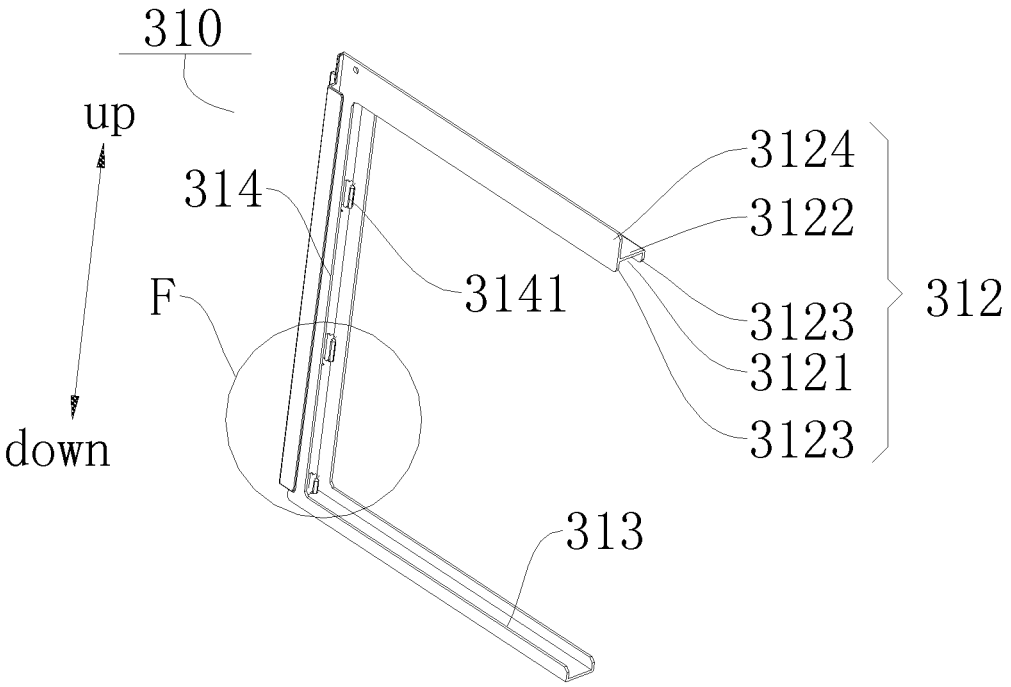
FIG. 13 is a schematic view of a sliding guiding portion of a window air conditioner according to an embodiment of the present invention.
Figure 14:
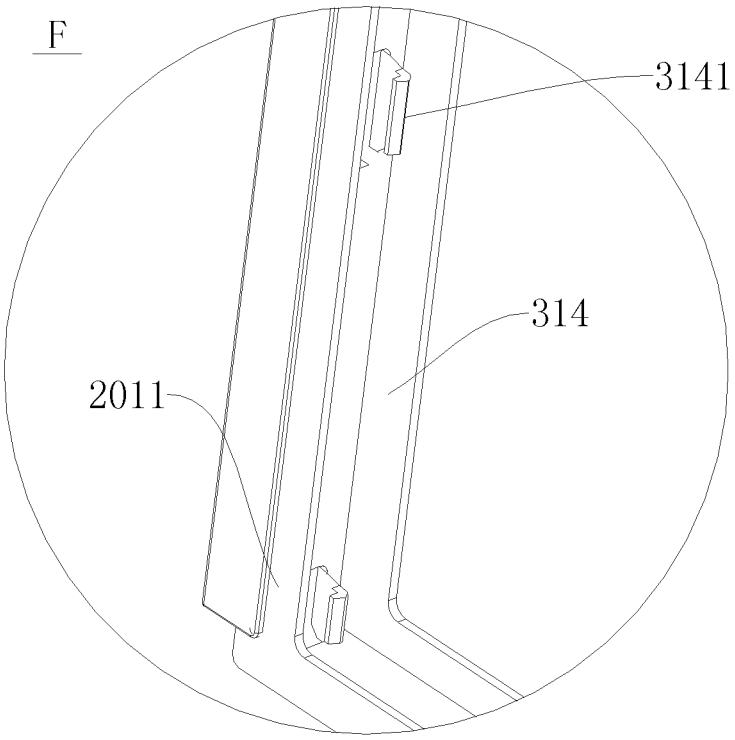
FIG. 14 is a partially enlarged view of portion F in FIG. 13.

According to some embodiments of the present invention, as shown in FIG. 12 to FIG. 14, at least one of the at least two layers of the heat-insulation sealing assembly 200 is connected with the mounting window in the sealing manner via a sliding guiding portion 310 slidably in a left and right direction with respect to the air conditioner body 100. It shall be noted that the heat-insulation sealing assembly 200 is connected with the mounting window in the sealing manner via the sliding guiding portion 310, such that the position of the heat-insulation sealing assembly 200 is easy to adjust via the sliding guiding portion 310 and the window air conditioner 1000 may be suitable for different installation conditions.

Further, the window air conditioner 1000 may further include a fixed guiding portion 320 disposed on the air conditioner body 100, in which the sliding guiding portion 310 is slidably fitted with the fixed guiding portion 320. The fixed guiding portion 320 may be used to guide the sliding guiding portion 310, such that the sliding guiding portion 310 can slide along a predetermined sliding direction and be prevented from being deviated from the predetermined direction, thus improving the structural stability of the fixed guiding portion 320 and the sliding guiding portion 310.

Figure 10:
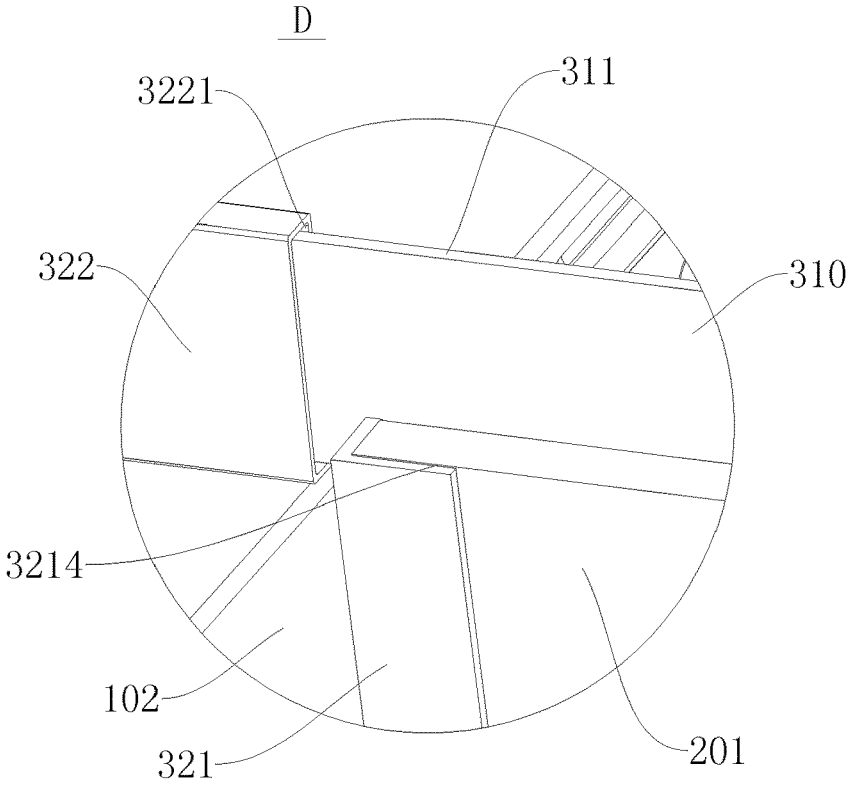
FIG. 10 is a partially enlarged view of portion D in FIG. 9.
Figure 20:
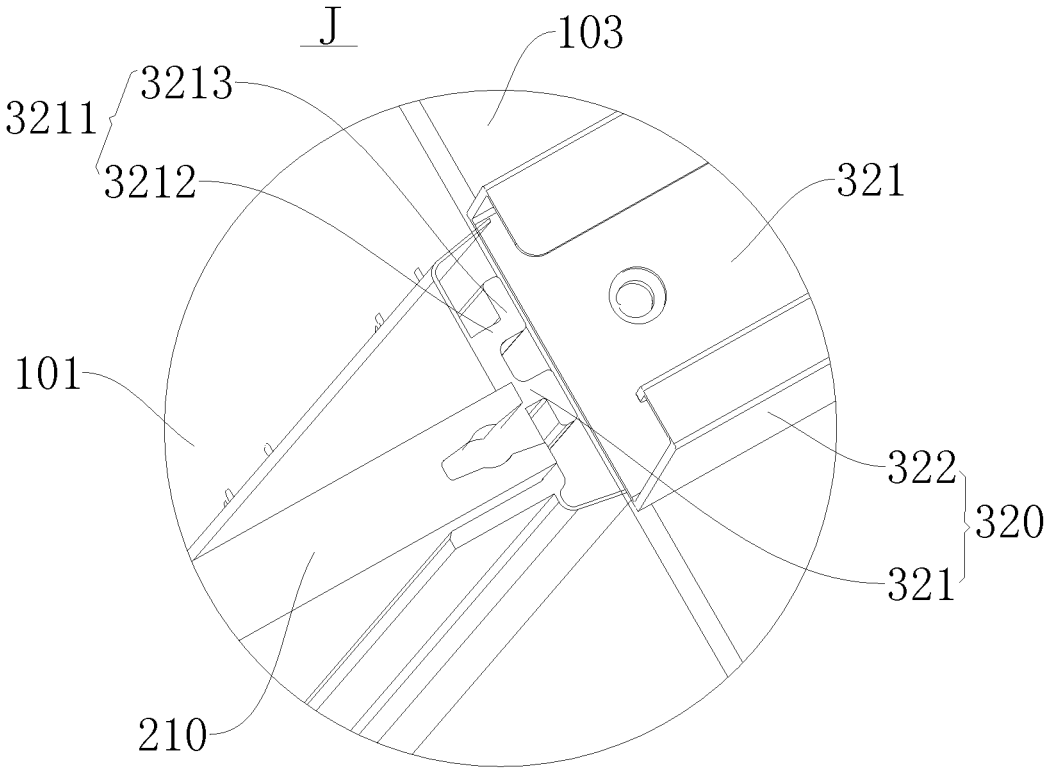
FIG. 20 is a partially enlarged view of portion J in FIG. 17.

As shown in FIG. 3, FIG. 10 and FIG. 20, the fixed guiding portion 320 may include a first fixed member 321 that is connected with the air conditioner body 100 and the heat-insulation sealing assembly 200 in a snap-fit manner respectively. Thus, it is convenient to mount the heat-insulation sealing assembly 200 to the air conditioner body 100.

Figure 7:
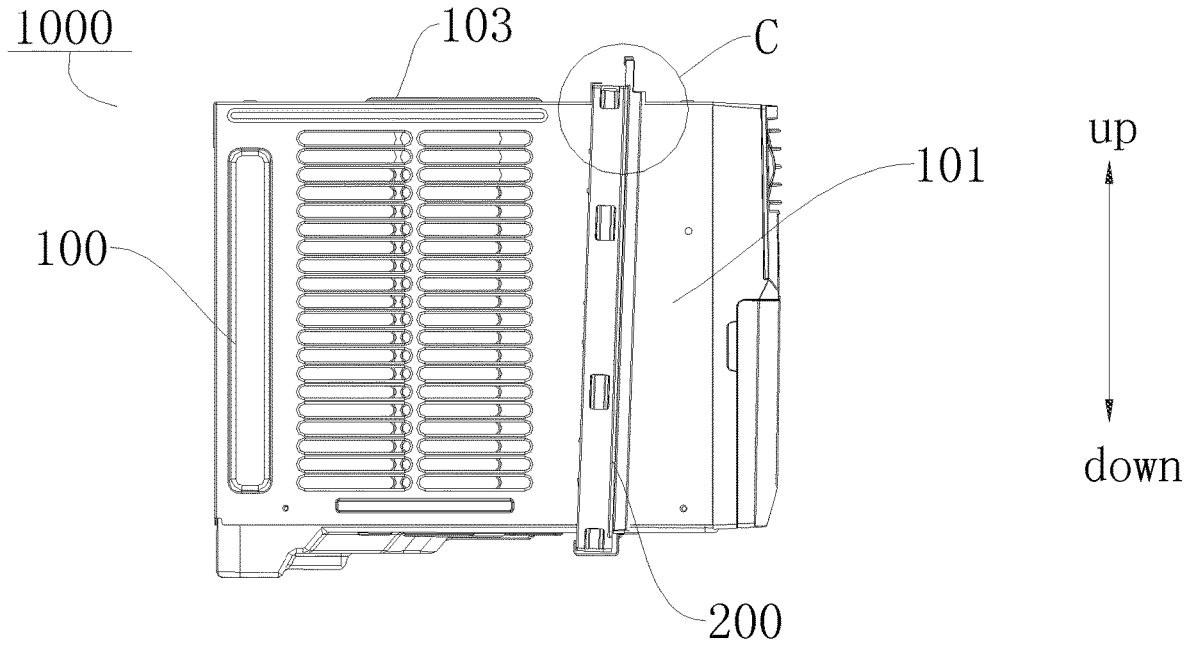
FIG. 7 is a left view of a window air conditioner according to an embodiment of the present invention.

In the example shown in FIG. 3, a first snap 3211 connected with the air conditioner body 100 in the snap-fit manner is provided at a side of the first fixed member 321, and a snap groove 120 matched with the first snap 3211 is provided in the side wall of the air conditioner body 100. Thus, it is convenient to mount the heat-insulation sealing assembly 200 to the air conditioner body 100. In order to further improve the reliability of connecting the heat-insulation sealing assembly 200 with the air conditioner body 100, a plurality of the snap grooves 120 are provided and spaced apart from one another along a length direction of the first fixed member 321. For example, as shown in FIG. 7, four snap grooves 120 are provided and spaced apart from one another along an up and down direction shown in FIG. 7.

Figure 8:
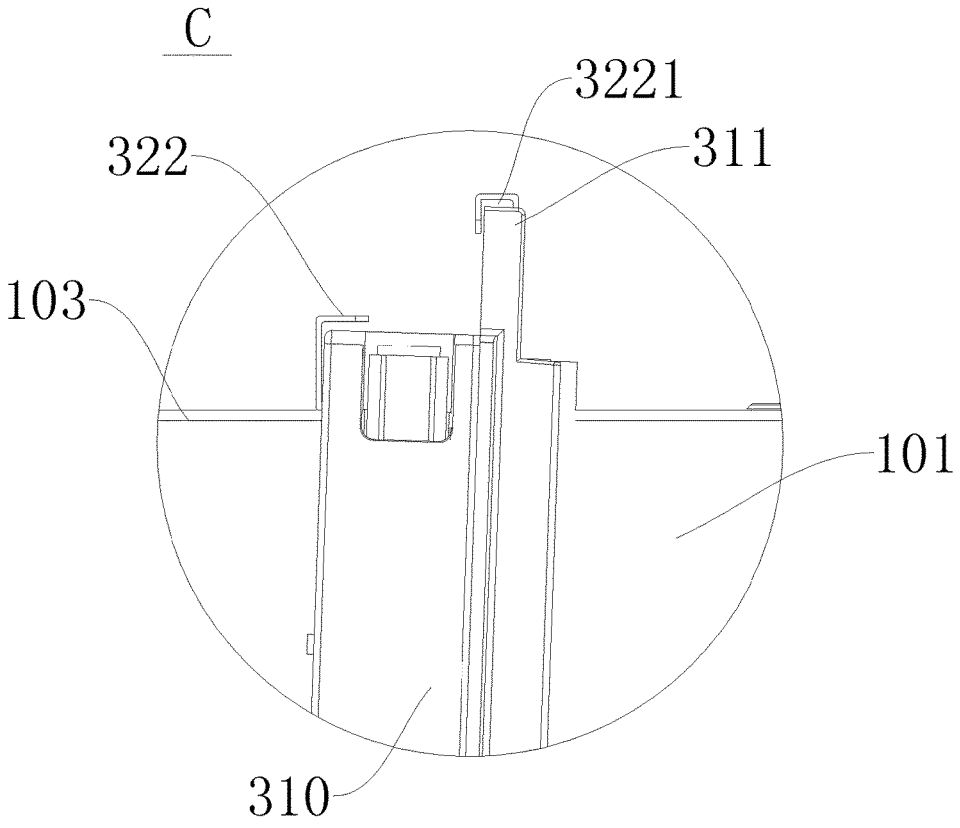
FIG. 8 is a partially enlarged view of portion C in FIG. 7.
Figure 9:
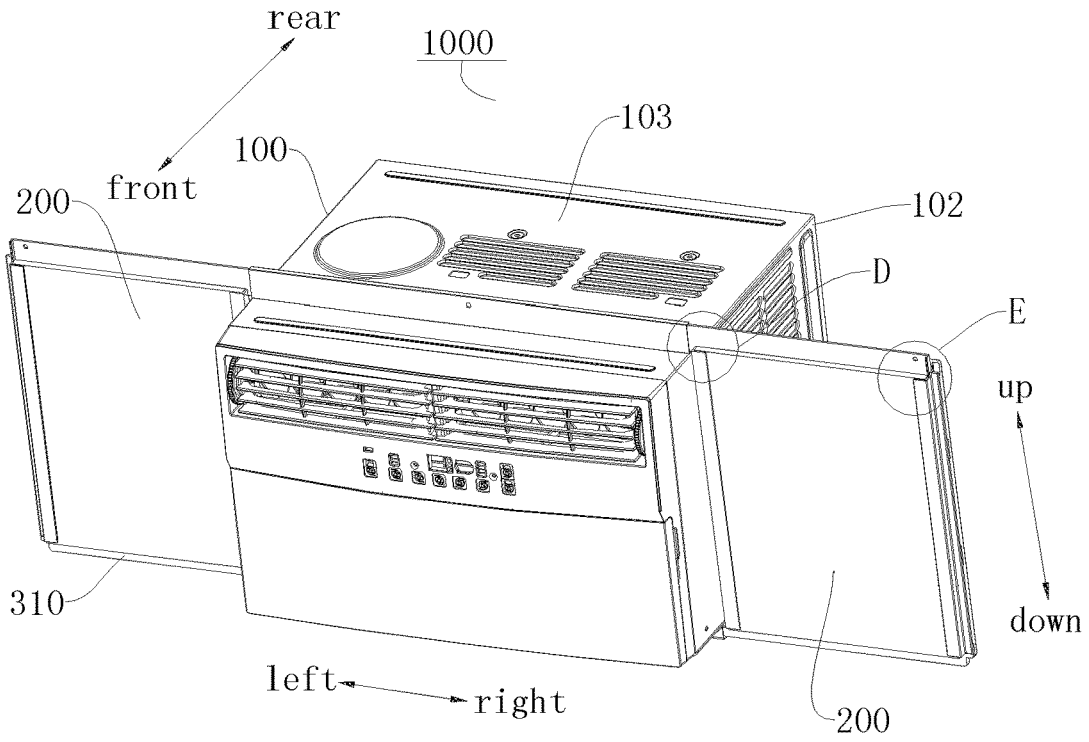
FIG. 9 is a perspective view of a window air conditioner according to an embodiment of the present invention.

Further, as shown in FIG. 3, the first snap 3211 may include an extending portion 3216 extending outwards from a side of the first fixed member 321 facing the air conditioner body 100, and the extending portion 3216 has two snapping members 3215 at a free end thereof and the two snapping members 3215 extend away from each other. As shown in FIG. 7 to FIG. 8, two side wings 110 are provided on the side wall of the air conditioner body 100 and spaced apart from each other, and configured to form the snap groove 120. Each side wing 110 is configured to have a substantial L shape. In the process of assembling the first snap 3211 and the air conditioner body 100, the first snap 3211 may be inserted into the snap groove 120 along the up and down direction shown in FIG. 7, to simplify the installation process of the first fixed member 321.

Figure 15:
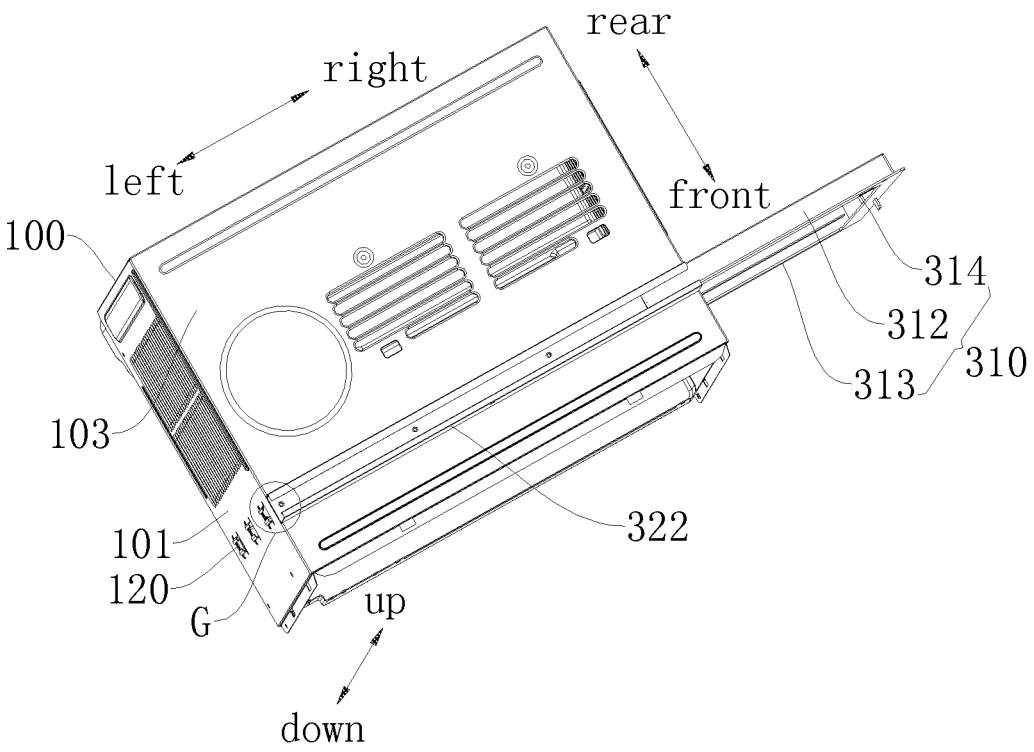
FIG. 15 is a partial schematic view of a window air conditioner according to another embodiment of the present invention.
Figure 16:
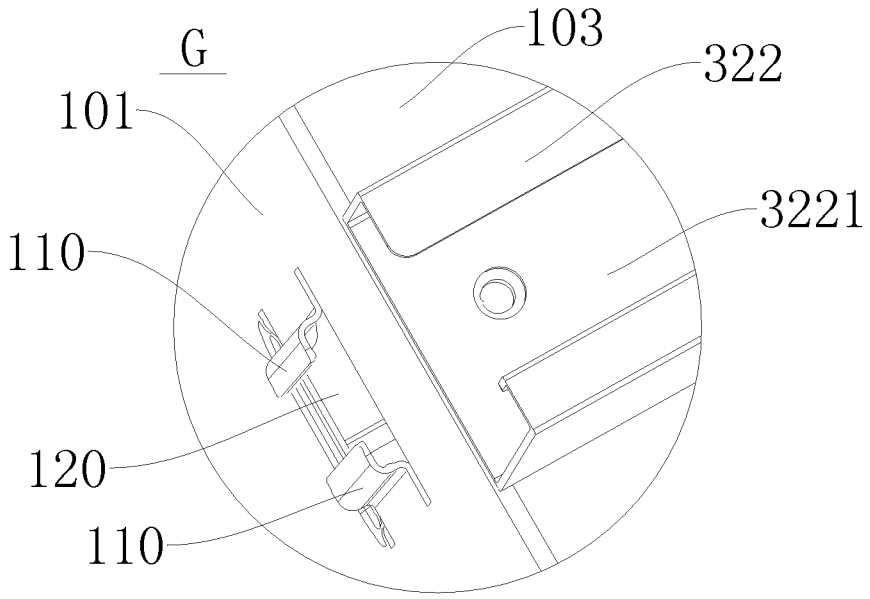
FIG. 16 is a partially enlarged view of portion G in FIG. 15.

Optionally, in other embodiments as shown in FIG. 20, the snap 3211 may include two first extending portions 3212 spaced apart from each other and extending outwards from a side of the first fixed member 321 facing the air conditioner body 100, and each first extending portion 3212 has a first snapping member 3213 at a free end thereof and two first snapping members 3213 extend away from each other. As shown in FIG. 15 to FIG. 16, two side wings 110 are spaced apart from each other and provided on the side wall of the air conditioner body 100, and configured to form the snap groove 120, and each side wing 110 is configured to have a substantial L shape. In the process of assembling the snap 3211 and the air conditioner body 100, the snap 3211 may be inserted into the snap groove 120 along the up and down direction shown in FIG. 15, to simplify the installation process of the first fixed member 321.

As shown in FIG. 5 to FIG. 10, FIG. 15 to FIG. 17 and FIG. 20, in embodiments of the present invention, the fixed guiding portion 320 may include a second fixed member 322 disposed on a top wall and/or a bottom wall of the air conditioner body 100, and the sliding guiding portion 310 is slidably disposed on the second fixed member 322, such that the sliding guiding portion 310 may slide along a predetermined sliding trace to improve the sliding stability of the sliding guiding portion 310. It can be understood that one second fixed member 322 may be provided and disposed on the top wall 103 or the bottom wall of the air conditioner body 100, or two second fixed member 322 may be provided and disposed on the top wall 103 and the bottom wall of the air conditioner body 100 respectively.

In the embodiment shown in FIG. 7 to FIG. 8, one of the second fixed member 322 and the sliding guiding portion 310 has a guiding groove 3221 extending along a sliding direction of the sliding guiding portion 310, and the other thereof has a guiding slide track 311 matched with the guiding groove 3221. Thus, the fitting stability between the second fixed member 322 and the sliding guiding portion 310 can be improved, and the sliding guiding portion 310 can slide along the predetermined trace. For example, as shown in FIG. 7 and FIG. 8, the second fixed member 322 has the guiding groove 3221 therein, the sliding guiding portion 310 has the guiding slide track 311 matched with the guiding groove 3221, and the guiding slide track 311 can move along the guiding groove 3221, so as to drive the sliding guiding portion 310 and the heat-insulation sealing assembly 200 to move, which may facilitate adjusting the position of the heat-insulation sealing assembly 200 to make the window air conditioner 1000 suitable for different installation conditions.

According to the embodiment of the present invention, as shown in FIG. 13 to FIG. 14, the sliding guiding portion 310 may include a first support plate 312 slidably fitted with the fixed guiding portion 320, and the first support plate 312 has a guiding sliding groove 3121 therein and the heat-insulation sealing assembly 200 (specifically, at least part of the heat-insulation sealing assembly 200, e.g., the sealing louver 202) is fitted in the guiding sliding groove 3121. Thus, the at least part of the heat-insulation sealing assembly 200 can move with respect to the air conditioner body 100 along the predetermined trace. In other words, the width of the sealing louver 202 in the left and right direction can be adjusted based on the size of the window, and also the heat insulation plate 202 having a corresponding size can be provided by cutting or other means, so as to make the heat-insulation sealing assembly 200 suitable for different installation conditions.

Further, the sliding guiding portion 310 may further include: a second support plate 313 and a connecting plate 314. As shown in FIG. 13, the second support plate 313 is paralleled to the first support plate 312 and spaced apart from the first support plate 312 in a length direction of the heat-insulation sealing assembly 200 (e.g. the up and down direction shown in FIG. 13). It shall be noted that the second support plate 313 may be fitted with the fixed guiding portion 320 in an indirect and slidable manner. The connecting plate 314 is connected between the first support plate 312 and the second support plate 313, and the heat-insulation sealing assembly 200 (at least part of the heat-insulation sealing assembly 200, e.g. the sealing louver 202) is connected with the connecting plate 314 in a snap-fit manner. Thus, the heat-insulation sealing assembly 200 (in particular, the sealing louver 202) can move with respect to the air conditioner body along the predetermined trace, so as to improve the stability and reliability of the motion of the heat-insulation sealing assembly 200.

Further, as shown in FIG. 13, the first support plate 312 may include: a main plate 3122, two side plates 3123 and a guiding plate 3124. The two side plates 3123 may be configured to define the guiding sliding groove 3121, and at least part (i.e., the sealing louver 202) of the heat-insulation sealing assembly 200 may be defined in the guiding sliding groove 3121. The two side plates 3123 are disposed at one side of the main plate 3122, and the guiding plate 3124 is disposed at the other side of the main plate 3122 and slidably fitted with the fixed guiding portion 320. For example, as shown in FIG. 13, the guiding plate 3124 is slidably fitted in the guiding groove 3221 of the second fixed member 322, a part of the first support plate 312 fitted with the guiding groove 3221 is configured as the guiding slide track 311, and under the guidance of the guiding groove 3221, the first support plate 312 can slide along the guiding groove 3221, thus driving the heat-insulation sealing assembly 200 (specifically, the sealing louver 202) to slide. As shown in FIG. 13, in order to improve a structural strength of the first support plate 312, the guiding plate 3124 is flush with one of the two side plates 3123.

According to the embodiment of the present invention, as shown in FIG. 2, FIG. 13 and FIG. 14, one of the connecting plate 314 and an end of the heat-insulation sealing assembly 200 opposite to the connecting plate 314 is provided with a second snap 2021, and the other thereof is provided with a snapping member 3141 connected with the second snap 2021 in the snap-fit manner. Thus, it is convenient to mount the sealing louver 202 to the connecting plate 314.

Further, as shown in FIG. 2, FIG. 13 and FIG. 14, the connecting plate 314 is provided with the snapping member 3141, and the end of the heat-insulation sealing assembly 200 opposite to the connecting plate 314 is provided with the second snap 2021. In the embodiment of the present invention, two or more than two snapping members 3141 may be formed at a side wall of the connecting plate 314 opposite to the heat-insulation sealing assembly 200, two or more than two second snap 2021 may also be provided and spaced apart from each other along the length direction of the heat-insulation sealing assembly 200 (e.g. the up and down direction shown in FIG. 13), and each second snap 2021 is connected with the corresponding snapping member 3141 in the snap-fit manner. Thus, the reliability and stability of connecting the heat-insulation sealing assembly 200 with the connecting plate 314 can be improved.

Figure 11:
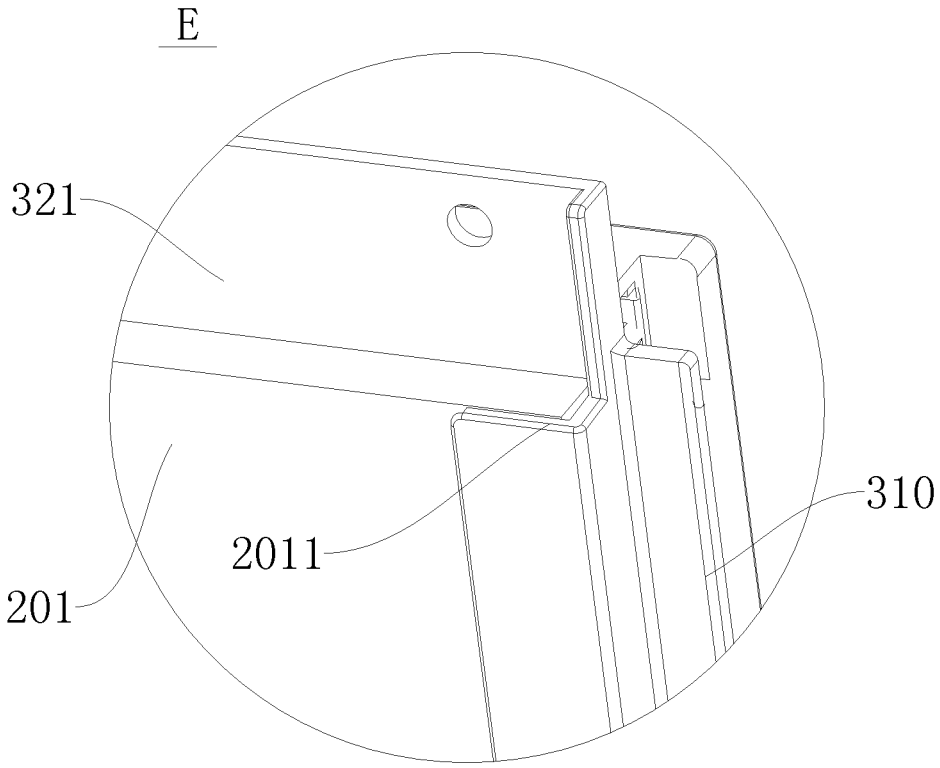
FIG. 11 is a partially enlarged view of portion E in FIG. 9.

In the embodiment, as shown in FIG. 11 to FIG. 12 and FIG. 14, the sliding guiding portion 310 is provided with a first mounting groove 2011 extending along the length direction (e.g. the up and down direction shown in FIG. 12) of the heat-insulation sealing assembly 200, and a part (e.g. the heat insulation plate 201) of the heat-insulation sealing assembly 200 is configured to be inserted into the first mounting groove 2011 along a length direction of the first mounting groove 2011. Thus, it is convenient to mount the heat-insulation sealing assembly 200 to the sliding guiding portion 310. For example, as shown in FIG. 12, one end of the part (e.g. the heat insulation plate 201) of the heat-insulation sealing assembly 200 may be inserted into the first mounting groove 2011 along a direction represented by arrow a in FIG. 12.

In order to further improve the stability of assembling the heat-insulation sealing assembly 200, according to the embodiment of the present invention, as shown in FIG. 10 and FIG. 12, the fixed guiding portion 320 is further provided with a second mounting groove 3214 opposite to the first mounting groove 2011, and the other end of the part (e.g. the heat insulation plate 201) of the heat-insulation sealing assembly 200 is mounted in the second mounting groove 3214. For example, as shown in FIG. 12, the heat insulation plate 201 of the heat-insulation sealing assembly 200 is inserted into the first mounting groove 2011 and the second mounting groove 3214 along the direction represented by arrow a in FIG. 12. Thus, it is convenient to assemble the heat insulation plate 201.

In the following, a window air conditioner 1000 according to embodiments of the present invention will be described in detail through specific embodiments with reference to FIG. 1 to FIG. 14. It should be understood that, descriptions below are only exemplary, and cannot be construed to limit the present invention.

As shown in FIG. 1 to FIG. 14, the window air conditioner 1000 includes an air conditioner body 100, a heat-insulation sealing assembly 200, a sliding guiding portion 310 and a fixed guiding portion 320.

Specifically, the window air conditioner 1000 is configured to be mounted to a mounting window, the air conditioner body 100 may be connected with the mounting window in a sealing manner via the heat-insulation sealing assembly 200, and the heat-insulation sealing assembly 200 has two layers, i.e., a sealing louver 202 and a heat insulation plate 201. The sealing louver 202 and the heat insulation plate 201 are provided between the air conditioner body 100 and the mounting window to insulate the inside of the mounting window from the outside of the mounting window.

As shown in FIG. 1 and FIG. 4, the sealing louver 202 is flexibly provided between the mounting window and the air conditioner body 100 and adjacent to the outside of the mounting window, while the heat insulation plate 201 is provided between the air conditioner body 100 and the mounting window and located adjacent to the inside of the mounting window, in which the sealing louver 202 may be connected with the mounting window via a sliding guiding portion 310. The fixed guiding portion 320 is provided on the air conditioner body 100, and a sliding guiding portion 310 is slidably fitted with fixed guiding portion 320.

As shown in FIG. 1 and FIG. 12, the sealing louver 202 is connected with the mounting window via the sliding guiding portion 310 in a sealing manner to facilitate adjusting the position of the heat-insulation sealing assembly 200 via the sliding guiding portion 310, so as to make the window air conditioner 1000 suitable for different installation conditions. The fixed guiding portion 320 is provided on the air conditioner body 100, and the sliding guiding portion 310 is slidably fitted with fixed guiding portion 320. Herein, the fixed guiding portion 320 may be configured to guide the sliding guiding portion 310, such that the sliding guiding portion 310 can slide along a predetermined sliding direction and be prevented from being deviated from the predetermined direction, thus improving the structural stability of the fixed guiding portion 320 and the sliding guiding portion 310.

As shown in FIG. 3 and FIG. 10, the fixed guiding portion 320 may include a first fixed member 321 and a second fixed member 322, and the first fixed member 321 is connected with the air conditioner body 100 and the heat-insulation sealing assembly 200 in a snap-fit manner respectively. Thus, it is convenient to mount the heat-insulation sealing assembly 200 to the air conditioner body 100.

Specifically, as shown in FIG. 3 and FIG. 7, a first snap 3211 connected with the air conditioner body 100 in the snap-fit manner is provided at a side of the first fixed member 321, and a snap groove 120 matched with the snap 3211 is provided in the side wall of the air conditioner body 100. In order to further improve the reliability of connecting the heat-insulation sealing assembly 200 with the air conditioner body 100, four snap grooves 120 are provided and spaced apart from one another along a length direction of the first fixed member 321 (i.e., an up and down direction in FIG. 7).

Further, as shown in FIG. 3, the first snap 3211 may include an extending portion 3216 extending outwards from a side of the first fixed member 321 facing the air conditioner body 100, and the extending portion 3216 has two snapping members 3215 at a free end thereof and the two snapping members 3215 extend away from each other. As shown in FIG. 7 to FIG. 8, two side wings 110 are provided on the side wall of the air conditioner body 100 and spaced apart from each other, and configured to form the snap groove 120. Each side wing 110 is configured to have a substantial L shape. In the process of assembling the first snap 3211 and the air conditioner body 100, the first snap 3211 may be inserted into the snap groove 120 along the up and down direction shown in FIG. 7, to simplify the installation 10 process of the first fixed member 321.

As shown in FIG. 10, the second fixed member 322 is disposed on a top wall 103 of the air conditioner body 100, and the sliding guiding portion 310 is slidably disposed on the second fixed member 322, such that the sliding guiding portion 310 can slide along a predetermined sliding trace to improve the sliding stability of the sliding guiding portion 310. As shown in FIG. 7 and FIG. 8, the second fixed member 322 has a guiding groove 3221 therein, the sliding guiding portion 310 has a guiding slide track 311 matched with the guiding groove 3221, and the guiding slide track 311 can move along the guiding groove 3221, so as to drive the sliding guiding portion 310 and the heat-insulation sealing assembly 200 to move, which may facilitate adjusting the position of the heat-insulation sealing assembly 200 to make the window air conditioner 1000 suitable for different installation conditions.

As shown in FIG. 13 to FIG. 14, the sliding guiding portion 310 may include: a first support plate 312, a second support plate 313 and a connecting plate 314. The second support plate 313 is paralleled to the first support plate 312 and spaced apart from the first support plate 312 in a length direction of the heat-insulation sealing assembly 200 (e.g. the up and down direction shown in FIG. 13). The second support plate 313 is slidably fitted with the fixed guiding portion 320. The first support plate 312 has a guiding sliding groove 3121 therein and the sealing louver 202 of the heat-insulation sealing assembly 200 is fitted in the guiding sliding groove 3121. Thus, the heat-insulation sealing assembly 200 can move with respect to the air conditioner body 100 along a predetermined trace.

The connecting plate 314 is connected between the first support plate 312 and the second support plate 313, and the heat-insulation sealing assembly 200 is connected with the connecting plate 314 in a snap-fit manner. Thus, it is convenient to assemble the heat-insulation sealing assembly 200 with the sliding guiding portion 310.

As shown in FIG. 13, the first support plate 312 may include: a main plate 3122, two side plates 3123 and a guiding plate 3124. The two side plates 3123 may be configured to define the guiding sliding groove 3121 and disposed at one side of the main plate 3122. The guiding plate 3124 is disposed at the other side of the main plate 3122 and slidably fitted with the fixed guiding portion 320. The guiding plate 3124 is slidably fitted in the guiding groove 3221 of the second fixed member 322, a part of the first support plate 312 fitted with the guiding groove 3221 is configured as the guiding slide track 311, and under the guidance of the guiding groove 3221, the first support plate 312 can slide along the guiding groove 3221 to drive the heat-insulation sealing assembly 200 (specifically, the sealing louver 202) to slide. As shown in FIG. 13, in order to improve the structural strength of the first support plate 312, the guiding plate 3124 is flush with one of the two side plates 3123. Herein, the second support plate 313 may have the same structure as the first support plate 312, which can reduce the number of components effectively and thus save the production cost.

As shown in FIG. 13 and FIG. 14, the connecting plate 314 is provided with a snapping member 3141, and an end of the heat-insulation sealing assembly 200 (specifically, the sealing louver 202) opposite to the connecting plate 314 is provided with a second snap 2021, so as to facilitate the snap-fit connection of the heat-insulation sealing assembly 200 and the connecting plate 314, thereby simplifying the procedures of assembling the heat-insulation sealing assembly 200 with the connecting plate 314. Two snapping members 3141 may be formed at a side wall of the connecting plate 314 opposite to the heat-insulation sealing assembly 200, and be spaced apart from each other along the length direction of the heat-insulation sealing assembly 200 (e.g. the up and down direction shown in FIG. 13), and the second snap 2021 is connected with the corresponding snapping member 3141 in the snap-fit manner. Thus, the reliability and stability of connecting the heat-insulation sealing assembly 200 with the connecting plate 314 can be improved.

As shown in FIG. 11 to FIG. 12 and FIG. 14, the sliding guiding portion 310 is provided with a first mounting groove 2011 extending along the length direction (e.g. the up and down direction shown in FIG. 12) of the heat-insulation sealing assembly 200, and the fixed guiding portion 320 is provided with a second mounting groove 3214 opposite to the first mounting groove 2011. One end of the heat insulation plate 201 is configured to be inserted into the first mounting groove 2011 along a length direction of the first mounting groove 2011, and the other end of the heat insulation plate 201 is mounted in the second mounting groove 3214. In the assembling process, the heat insulation plate 201 of the heat-insulation sealing assembly 200 may be inserted into the first mounting groove 2011 and the second mounting groove 3214 along a direction represented by arrow a in FIG. 12, which can not only facilitate the assembling of the heat insulation plate 201, but also improve the stability of assembling the heat-insulation sealing assembly 200.

With the window air conditioner 1000 according to the embodiments of the present invention, by using the sealing heat insulation assembly 200 having at least two layer, the inside and outside of the mounting window are separated from each other effectively to decrease the heat-exchange efficiency between the inside and outside of the mounting window, so as to reduce the power consumption of the window air conditioner 1000 and save resources.

Reference throughout this specification to "an embodiment," "some embodiments," "an exemplary embodiment," "an example," "a specific example," or "some examples," means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples.

Although embodiments of the present invention have been shown and described, it would be appreciated by those skilled in the art that changes, modifications, alternatives and variations can be made in the embodiments without departing from the scope of the present invention. The scope of the present invention is defined by the claims and the like.

What is claimed is:

1. A window air conditioner, comprising:

an air conditioner body configured to be mounted to a mounting window;

a heat-insulation sealing assembly having at least two layers and provided between the air conditioner body and the mounting window to insulate an inside of the mounting window from an outside of the mounting window in a sealing manner; and a sliding guiding portion slidable in a left-and-right direction with respect to the air conditioner body, the sliding guiding portion including:

a mounting groove arranged at one end of the sliding guiding portion that is distal from the air conditioner body, the mounting groove extending along a length direction of the heat-insulation sealing assembly that is approximately perpendicular to the left-and-right direction; and a vertical groove arranged at the one end of the sliding guiding portion, the vertical groove being separated from the mounting groove and extending approximately parallel to the mounting groove, wherein:

the at least two layers of the heat-insulation sealing assembly include a heat insulation plate and a sealing louver that are arranged substantially parallel to and spaced apart from each other in a direction from the inside of the mounting window to the outside of the mounting window, one end of the heat insulation plate that is distal from the air conditioner body is inserted in the mounting groove, and one end of the sealing louver that is distal from the air conditioner body is coupled in the vertical groove.

2. The window air conditioner according to claim 1, wherein a thickness of at least one of the at least two layers of the heat-insulation sealing assembly is adjustable.

3. The window air conditioner according to claim 1, wherein at least one of the at least two layers of the heat-insulation sealing assembly is connected with the mounting window in the sealing manner via the sliding guiding portion.

4. The window air conditioner according to claim 3, further comprising a fixed guiding portion disposed to the air conditioner body, wherein the sliding guiding portion is slidably fitted with the fixed guiding portion.

5. The window air conditioner according to claim 4, wherein the fixed guiding portion comprises a first fixed member connected with the air conditioner body and the heat-insulation sealing assembly in a snap-fit manner respectively.

6. The window air conditioner according to claim 5, wherein a first snap connected with the air conditioner body in the snap-fit manner is provided at a side of the first fixed member, and a snap groove matched with the first snap is provided in the side wall of the air conditioner body.

7. The window air conditioner according to claim 6, wherein the first snap comprises an extending portion extending outwards from a side of the first fixed member facing the air conditioner body, the extending portion has two snapping members at a free end thereof and the two snapping members extend away from each other;

two side wings are provided on the side wall of the air conditioner body and spaced apart from each other, and configured to form the snap groove, and each side wing is configured to have a substantial L shape.

8. The window air conditioner according to claim 4, wherein the fixed guiding portion comprises a second fixed member disposed on a top wall and/or a bottom wall of the air conditioner body, and the sliding guiding portion is slidably disposed to the second fixed member.

9. The window air conditioner according to claim 8, wherein one of the second fixed member and the sliding guiding portion has a guiding groove extending along a sliding direction of the sliding guiding portion, and the other thereof has a guiding slide track matched with the guiding groove.

10. The window air conditioner according to claim 4, wherein the sliding guiding portion comprises a first support plate slidably fitted with the fixed guiding portion, and the first support plate has a guiding sliding groove and at least a part of the heat-insulation sealing assembly is fitted in the guiding sliding groove.

11. The window air conditioner according to claim 10, wherein the sliding guiding portion further comprises:

a second support plate paralleled to the first support plate and spaced apart from the first support plate in the length direction of the heat-insulation sealing assembly; and a connecting plate connected between the first support plate and the second support plate, wherein the heat-insulation sealing assembly is connected with the connecting plate in a snap-fit manner.

12. The window air conditioner according to claim 4, wherein:

the mounting groove is a first mounting groove, and the one end of the heat insulation plate that is distal from the air conditioner body is configured to be inserted into the first mounting groove along a length direction of the first mounting groove, and the fixed guiding portion is provided with a second mounting groove opposite to the first mounting groove, and another end of the heat insulation plate that is proximal to the air conditioner body is configured to be mounted in the second mounting groove.

13. The window air conditioner according to claim 1, wherein the sealing louver is flexibly provided between the mounting window and the air conditioner body and adjacent to the outside of the mounting window, and the heat insulation plate is provided adjacent to the inside of the mounting window.

* * * * *